US005290324A

United States Patent [19]

Yokokawa et al.

[11] Patent Number: 5,290,324

[45] Date of Patent: Mar. 1, 1994

[54] COAL-WATER MIXTURE USING UPGRADED LOW-RANK COAL AND PROCESS FOR PRODUCING SAID MIXTURE

[75] Inventors: Chikao Yokokawa, Kyoto; Sadao Wasaka, Hatogaya, both of Japan

[73] Assignee: Mitsui Mining Company, Limited, Tokyo, Japan

[21] Appl. No.: 903,453

[22] Filed: Jun. 24, 1992

[51] Int. Cl.[5] ..... C10L 1/32

[52] U.S. Cl. ..... 44/280; 44/592; 44/608; 44/620

[58] Field of Search ..... 44/280, 608, 620, 592

[56] References Cited

U.S. PATENT DOCUMENTS

| | | | |
|---|---|---|---|
| 4,047,898 | 9/1977 | Cole et al. | 44/280 |
| 4,104,035 | 8/1978 | Cole et al. | 44/280 |
| 4,436,528 | 3/1984 | Schick et al. | 44/280 |
| 4,783,198 | 11/1988 | Hueschen | 44/280 |
| 4,904,277 | 2/1990 | Najjar et al. | 44/280 |

OTHER PUBLICATIONS

Fukuhara et al., "The Up-Grading of Low Rank Coals By Hydrothermal Treatment"; Papers For 27th Annual Conf. of Coal Science (1990), The Fuel Society Corp. (Nov. 29-30, 1990) Tokyo pp. 218-221.

*Japanese Industrial Standard* (JIS), M8812, 1984 pp. 1-25.

Roggoni, T. C. et al., International H. Minning and Eng., 2, (1984) pp. 157-169.

Potas, T. A., et al, Chem. Eng Commun., vol. 44, 1986 pp. 141-151.

Yokoyama et al., Journal of The Fuel Society of Japan 57 (1977) pp. 182-189.

Takemura et al., Fuel, vol. 60, (May 1981), pp. 379-384.

*Primary Examiner*—Jacqueline V. Howard

*Attorney, Agent, or Firm*—Fisher, Christen & Sabol

[57] ABSTRACT

The present invention provides a process for producing a coal-water mixture using a reaction mixture obtained by subjecting a low-rank coal of high water content to a hydrothermal treatment in the presence of carbon monoxide and water at a temperature not higher than the critical temperature of water. The above hydrothermal treatment makes the walls of pores present in the coal hydrophobic and densifies the coal matrix, whereby the coal after the treatment has a lower equilibrium moisture content. Hence, it becomes possible to produce a coal-water mixture containing a high concentration of coal and having good stability and fluidity, from a low-rank coal of high water content which has been unusable as a material for a coal-water mixture. Further, in the production of a coal-water mixture from the above reaction mixture, the amount of surfactant used can be reduced because the liquid phase of the reaction mixture contains a large amount of humic acid having surface activity.

4 Claims, No Drawings

COAL-WATER MIXTURE USING UPGRADED LOW-RANK COAL AND PROCESS FOR PRODUCING SAID MIXTURE

BACKGROUND OF THE INVENTION

1. Field of the Invention

The present invention relates to a coal-water mixture using an upgraded low-rank coal obtained by upgrading a low-rank coal of high water content, as well as to a process for producing said mixture. The coal-water mixture can be used as a fuel as it is.

2. Description of the Prior Art

Many of low-rank coals having a carbon content of 60–75% by weight on a dry ash-free basis, have a water (inherent water) content specified by Japanese Industrial Standard (JIS) M 8812, (1984), pages 1–25, of as high as 20–30%, and some of them show a water (equilibrium moisture) content at room temperature and 98% relative humidity, of as high as 60–70% depending upon the kind of coal. Transportation of such high-water-content coals as they are is uneconomical and the efficiency in their use as a fuel or in other applications is low. In order to reduce the water content in coal, it is considered to dry coal by, for example, hot-air or natural draft; however, the dried coal reabsorbs water during storage or transportation and further there is a fear that during the process of water reabsorption the coal undergoes pulverization or invites spontaneous combustion. Because of these problems, low-rank coals find limited applications, and most of them remain unutilized although their reserves are very large.

In order to seek effective utilizations of low-rank coals of high water content, there were proposed various methods for the upgrading of low-rank coal by lowering the equilibrium moisture content of the coal. As such methods, there are known, for example, (1) a Fleissner method which comprises lowering the water content in coal by using a saturated steam of a temperature of 473°–573° K. and a pressure of 1.5–8.5 MPa [e.g., T. G. Rozgonyi and I. Z. Szigeti, International J. Mining and Eng., 2, (1984), 157–169] and (2) a hydrothermal method which comprises upgrading a coal-water mixture in a pressurized water of a temperature of 473°–603° K. and a pressure of 1.5–17 MPa [e.g., T. A. Potas, R. E. Sears, D. J. Maas, G. G. Baker and W. G. Willson, Chem. Eng. Commun. Vol. 44, (1986), pp. 135–151]. These methods are effective for the upgrading and consequent water reduction of low-rank coal; however, equilibrium moisture content is reduced to about 11–20% at best. A higher treating temperature and a longer treating time tend to give a higher level of upgrading, but a lower temperature and a shorter time are desirable when the treatment is conducted industrialy. Further, the treating temperature is limited by the pressure of the saturated steam employed. Owing to these restrictions, equilibrium moisture content is reduced to about 11% at best in the above methods. Equilibrium moisture content reduction of such a degree is insufficient for use of low-rank coals in wider applications.

On the other hand, there is known a method for coal treatment using water and carbon monoxide [the technological field of this method is different from that of the present invention process for coal pretreatment (coal upgrading)]. As such a method, there is known a technique which comprises heating coal and the oil derived from coal in the presence of a very small amount of water and carbon monoxide at a temperature higher than the critical temperature (647.3 K) of water (i.e. in a state that no liquid water exists) to give rise to a water gas reaction between water and carbon monoxide ($CO+H_2O \rightarrow CO_2+H_2$) and allowing the nascent hydrogen to act on the coal in the presence of a particular catalyst to give rise to coal liquefaction [Yokoyama et al., Journal of the Fuel Society of Japan, 57, (1977), 182–189]. This technique aims at coal decomposition and liquefaction and is therefore essentially different from and not applicable to a technique for reduction of water occluded in coal.

Thus, a method for upgrading low-rank coal to a reduced water content has heretofore been sought for wider application of such coal.

Various proposals were also made to convert a coal to a liquid fuel which is easy to transport, which can be used as a fuel as it is, and which is easy to handle for combustion. One of such proposals relates to a coal-water mixed slurry (hereinafter referred to as CWM). Many researches were already made on the production of CWM, and a number of factors governing the properties of CWM were found. The most important factor governing the CWM properties is the amount of water occluded in coal. That is, for production of a CWM of high coal concentration, it is desirable that the content of water occluded in the fine pores of coal particles (said water reduces the calorie of CWM but makes no contribution to the improvement of CWM fluidity) be as small as possible. Since the amount of water occluded in the fine pores of coal particles is thought to be approximately proportional to the amount of equilibrium moisture of the coal particles present in an atmosphere of room temperature and a 98% or more relative humidity, said amount of equilibrium water can be used as a yardstick for the producibility of CWM.

Viewed from the equilibrium water content, low-rank coals as mentioned above, each have a large amount of occluded water. Because of the large amount of occluded water, low-rank coals have been difficult to convert to a CWM of high calorie. In order to produce a good CWM, it is necessary to pay attention not only to the amount of water occluded in coal used as a material but also to the storage- or transportation-related properties (e.g. fludity, stability) of CWM produced.

The properties of CWM (e.g. coal content, viscosity, stability) are greatly influenced by the amount of water present in the CWM together with coal particles. A relatively small water amount of 2–3% based on coal has a detrimental effect on CWM properties, in many cases.

Hence, in order to obtain a good CWM, there must be found a solution to technical tasks which seem contradictory with each other, i.e. (1) a small amount of water occluded in coal particles and (2) the presence of water between coal particles.

SUMMARY OF THE INVENTION

The present invention has been completed in order to solve the above technical tasks and relates to a coal-water mixture using an upgraded coal obtained by subjecting a low-rank coal to a particular hydrothermal reaction, as well as to a process for producing said mixture. In the present invention, a low-rank coal is upgraded in the presence of water and carbon monoxide at a temperature not higher than the critical temperature of water (i.e. in a state that liquid water exists), whereby the walls of pores in the coal are made hydrophobic and the coal matrix is densified; consequently, the equilibrium moisture content in coal after thermal treatment can be reduced to less than about 11% (which has been a limit for the conventional techniques). Further, since the liquid phase of the reaction mixture after the thermal reaction contains a relatively large amount of organic carboxylic acids (known generically as humic acid) having surface activity, the CWM obtained from the reaction mixture has improved fluidity and stability. Furthermore, the thermal reaction and the CWM production can be conducted in a substantially continuous procedure; that is, the reaction mixture after thermal reaction is per se subjected to water content adjustment, etc. to obtain a desired CWM.

By thus treating a low-rank coal of high water content to convert to an upgraded coal, it is possible to produce, from said low-rank coal, a CWM of high coal concentration having good stability and fluidity wherein a smaller amount of a surfactant is used.

The present invention provides a process for producing a coal-water mixture usable as a fuel as it is, which process comprises:

heat-treating a low-rank coal having a carbon content (on dry ash-free basis) of 75% or less and a water (inherent moisture) content of 10% or more, or a water (equilibrium moisture) content of 15% or more at room temperature and 98% relative humidity, in the presence of water and carbon monoxide at a temperature of 647.3° K. (the critical temperature of water) or below in a pressure vessel, and recovering the reaction mixture comprising coal and water, from the pressure vessel, adding or not adding thereto a surfactant, and adding the required amount of water to obtain a slurry.

The present invention further provides a coal-water mixture usable as a fuel as it is, which is obtained by the above process and which comprises 30–35% of water, 65–70% of a coal, 0–0.7% of a surfactant and a small amount or zero amount of a filler, the particle size of the coal being such that the proportion of the coal portion passing through a 200-mesh filter is 80% by weight or more.

DETAILED DESCRIPTION AND THE PREFERRED EMBODIMENTS

The present inventors made study on a method for upgrading a low-rank coal (low-rank coals have had problems in transportation, etc., owing to the high water content), to reduce the equilibrium moisture content and enable production of CWM using the upgraded coal. As a result, the present inventors found that by heat-treating a low-rank coal under particular conditions and using substantially all the components of the resulting reaction mixture, there can be obtained a CWM which is superior in fluidity, etc. and which contains a coal of low equilibrium moisture content (such a coal of low equilibrium moisture content has been difficult to obtain according to the conventional upgrading methods). The finding has led to the completion of the present invention. Said CWM is produced from a low-rank coal (the starting material) and, unlike those obtained by the conventional processes for CWM production, has a high coal content and yet possesses good properties.

The process of the present invention can be carried out as follows, for example. Into a pressure container such as autoclave or the like are fed water and a low-rank coal. Then, carbon monoxide is fed under pressure. The system is maintained at a reaction temperature of 523° K. to 647.3° K. (the critical temperature of water) and a reaction is carried out, whereby a slurry containing an upgraded coal of low equilibrium water content can be obtained. The liquid phase of the slurry (reaction mixture) contains large amounts of organic carboxylic acids (generically called as humic acid) which are formed by the reaction. This humic acid has a surface activity. Hence, in producing a CWM using said reaction mixture, the amount of surfactant added can be reduced or made zero by appropriately setting the conditions of the above heat treatment.

In the present invention, "low-rank coal" refers to a coal having a carbon content (of dry ash-free basis) of 75% or less, or a water (inherent moisture) content specified by JIS M 8812, of 10% or more, or a water (equilibrium moisture) content of 15% or more at room temperature and 98% relative humidity. The present invention, however, is applicable also to coals not meeting the above conditions as well as to other coals.

As the apparatus used for the heat treatment, a pressure vessel is used because the heat treatment is conducted at a pressure higher than normal pressure. A pressure vessel such as batchwise or continuous autoclave can be used preferably. The pressure vessel has no particular restriction.

The weight ratio of the water and coal (water/coal) fed into the pressure vessel can be appropriately selected depending upon the type of pressure vessel, the procedure used after the heat treatment and so forth, but is approximately in the range of 0.3–3.0. The amount of water fed is such that the water can make sufficient contact with coal particles during the heat treatment. The particle size of the coal fed is practial at 32 to 60 mesh or smaller, or alternatively about 200 mesh or smaller. If the particle size is about 200 mesh or smaller, no further adjustment of the size is necessary after the heat treatment in order to impart fluidity and stability to the CWM using the upgraded coal. The particle size can be about 8–20 mesh when the upgraded coal is used for applications other than CWM production after the draining-off of water or is transported.

In order to generate hydrogen by a water gas reaction between water and carbon monoxide, carbon monoxide of high partial pressure is used. The high partial pressure makes the pressure of the reaction system high, which brings about facility and economical problems in carrying out said reaction industrially. Hence, carbon monoxide of high purity is used and the amount of carbon monoxide is preferably selected in the range of 1 to 5 MPa (gauge) in terms of the partial pressure of carbon monoxide in the reaction system during the reaction, in view of the practicality. The reaction temperature is preferably 523 K to 647.3 K (the critical temperature of water). When the temperature is lower than 523° K., the reaction rate is low and is not practical. When the temperature is higher than 647.3° K. which is the critical temperature of water, the coal to be treated gives rise to pyrosis and is not preferable.

As to the relation of the partial pressure of carbon monoxide and the reaction temperature. For example, when a high reaction temperature is required depending upon the kind of the coal to be treated, the partial pressure of carbon monoxide is lowered to reduce the total pressure in the reaction system.

The reaction time can be appropriately selected depending upon, for example, the kind of the coal to be treated and the type of the pressure vessel used for the heat treatment, but is approximately 0.2–6 hours. When the reaction time is too short, no sufficient upgrading effect is obtained. A longer reaction time can give a lower equilibrium moisture content, but too long a reaction time gives no further reduction in equilibrium water content.

The chemical oxygen demand (COD) of the liquid phase in the slurry recovered from the pressure container after the heat treatment, tends to be larger when the treating temperature is higher, both in the conventional hydrothermal treatment and in the heat treatment of the present invention. However, the COD is more striking in the present heat treatment using carbon monoxide and is about two times the COD obtained in the conventional treatment. The COD obtained in the heat treatment using no carbon monoxide is, for example, about 3,600 ppm (this value varies depending upon the conditions of heat treatment); in contrast, the COD obtained in the present heat treatment using carbon monoxide is as high as about 7,500 ppm. In the present invention, the COD value becomes higher when the heat treatment is conducted with $K_2CO_3$ added, although the addition has no direct effect on coal upgrading. The main components other than water, in the liquid phase are organic carboxylic acids generically called as humic acid. Since this humic acid has surface activity, the presence of humic acid in the liquid phase can reduce the required amount of a surfactant down to, depending upon the case, zero amount in production of CWM from the slurry.

The reason why the heat treatment can reduce the equilibrium water content of low-rank coal, is presumed to be as follows. The water gas equilibrium reaction between water and carbon monoxide generates nascent hydrogen (H); this H acts on a low-rank coal to reduce the oxygen containing-functional groups in the coal; thereby, the walls of the pores in the coal become hydrophobic, the hydrogen bond-based crosslinks with which said functional groups are associated are disintegrated, and the coal matrix is densified; as a result, the equilibrium moisture content in upgraded coal becomes lower. This presumption holds also from the fact that when the hydrothermal treatment is conducted using hydrogen ($H_2$) in place of carbon monoxide (CO), substantially no coal upgrading is realized as compared with the conventional hydrothermal treatment.

Owing to the present heat treatment, the walls of pores in coal become hydrophobic and the coal matrix is densified; as a result, the equilibrium moisture content (ordinarily about 20–30%) of low-rank coal can be reduced to about 11% or less and there can be obtained an upgraded coal whose water reabsorption amount is small. The heat-treated mixture of slurry state, after the heat treatment, is subjected, without being dried and as it is, to water content adjustment and can be preferably used as a material for CWM production.

The production of CWM can be carried out as follows, for example. The heat-treated mixture (slurry) obtained by the heat treatment of low-rank coal is subjected to water content adjustment; to the resulting mixture is added a surfactant as necessary in order for the CWM finally obtained to have stability and fluidity; and mixing is conducted to obtain a CWM. The surfactant used herein has no particular restriction, but for obtaining a CWM of high coal content, there is preferred, for example, a surfactant composed mainly of a sodium naphthalenesulfonate-formalin condensate, having a water content-reducing effect, a dispersing effect, etc. PH adjustment may be conducted for the liquid phase of CWM slurry in order to maximize the surfactant effect, depending upon the kind of surfactant used. Since the heat-treated mixture (slurry) obtained by the heat treatment of low-rank coal contains a component having surface activity, the amount of the surfactant newly added is smaller as compared with the conventional case for CWM production from bituminous coal. The approximate composition of CWM generally consists of 30–35% of water, 65–70% of a coal, 0.2–0.7% of a surfactant and, as necessary, a very small amount of a filler such as kaolinite or the like. The composition can be appropriately adjusted depending upon the application of CWM. The particle size of coal present in a CWM is preferably such that the proportion of the coal portion passing through a 200-mesh filter is about 80% by weight or more. Such a particle size can be obtained by separating the coal phase from the liquid phase of the reaction mixture after the heat treatment, subjecting the coal phase to particle size adjustment using a ball mill or the like, and uniformly mixing the resulting coal phase with the liquid phase, or by subjecting the reaction mixture itself to particle size adjustment using a ball mill or the like, or by subjecting a low-rank coal before heat treatment to particle size adjustment.

The present invention makes it possible to easily produce, from a low-rank coal having a carbon content of 75% or less and an equilibrium moisture content of about 20–30%, a CWM which has a high coal content, which has good stability and fluidity, and which allows for easy long-distance transportation. In the production of CWM, the heat-treatment mixture after heat treatment can be used as it is, because it gives a convenient operation and is preferable. However, it is possible that an upgraded coal be obtained from the reaction mixture and then a CWM is produced using the upgraded coal. In the latter case, the whole or part of the separated liquid phase may be used.

The present invention is described more specifically by way of Examples.

Prior to heat treatment, three kinds of coals shown in Table I were subjected to particle size adjustment to obtain samples each having a particle size of 32–60 meshes. In Table I, the elemental analysis data are expressed on dry ash-free basis and the technical analysis data are those obtained in accordance with Japanese Industrial Standard (JIS) M 8812.

First, that the equilibrium water content of low-rank coal can be reduced by subjecting the coal to the heat treatment of the present invention, is shown in Reference Examples 1–15.

REFERENCE EXAMPLES 1–15

10 g (on dry ash-free basis) of a low-rank coal (hereinafter referred to simply as coal) A, B or C as the starting material, shown in Table 1 and 20 g of pure water were fed into an autoclave having an internal volume of 50 $cm^3$. As shown in Table 2, carbon monoxide of 0.5 or 5 MPa (gauge) at room temperature was introduced into the autoclave and the mixture was kept at 553° K., 573° K. or 593° K. for 0.5 or 6 hours with stirring, to conduct a heat treatment. After the heat treatment, the heat-treatment mixture (slurry) was filtered to separate the upgraded coal from the liquid phase component. The upgraded coal was measured for yield on dry coal basis [ratio (%) of upgraded coal amount to material coal amount], elemental analysis and equilibrium moisture contents at room temperature and 75% and 100% relative humidities. The liquid phase component was measured, right after filtration of the slurry recovered from the autoclave, for chemical oxygen demand (COD) in accordance with JIS K 0101. Also, 10 g of the coal A, B or C and 30 g of pure water (with no carbon monoxide used) were subjected to the same heat treatment. All of the results are shown in Table 2.

As is clear from Table 2, in the conventional hydrothermal treatment using no carbon monoxide, shown in Reference Examples 9–15, reduction of equilibrium water content at 100% relative humidity to about 11% or less was very difficult. In contrast, in the heat treatment of the present invention shown in Reference Examples 1–8, equilibrium moisture content was securely reduced to 6–8% and, even in the coal A which was regarded to be very difficult to upgrade, to 10%.

As is clear from Table 3, in Reference Example 17 using hydrogen in place of carbon monoxide, coal upgrading was slightly seen as compared with Reference Example 18 using neither carbon monoxide nor hydrogen, but was extremely low as compared with Reference Example 16 using carbon monoxide.

With respect to COD, while a high COD value (a COD value when 10 g of a coal and 20 ml of water were treated) was obtained in each heat treatment using carbon monoxide (Table 2, Reference Example 1–8), 1,450 ppm was obtained in the heat treatment of Reference Example 17 using hydrogen, which was not much different from the COD values obtained in the conventional hydrothermal treatments (Table 2, Reference Examples 9–15).

The COD value when a heat treatment was conducted using a $K_2CO_3$ under the same conditions as in Reference Example 9, was very high (7,070 ppm). In the liquid phase after the heat treatment, humic acid was present in the form of potassium salt. $K_2CO_3$ has no effect on coal upgrading, but the presence of a large amount of the above potassium humate acting as a surfactant is convenient for production of CWM.

TABLE 1

| Kind of coal | Elemental analysis (%) (dry ash-free basis) Carbon | Hydrogen | Technical analysis (%) (constant humidity sample basis) Water | Fixed carbon | Volatile matter | Ash | Equilibrium moisture (%) Relative humidity (75%) | Relative humidity (100%) |
|---|---|---|---|---|---|---|---|---|
| A | 67.6 | 6.4 | 13.5 | 33.5 | 52.0 | 1.0 | 13.7 | 28.0 |
| B | 70.8 | 4.9 | 19.9 | 42.3 | 37.3 | 0.5 | 20.1 | 28.1 |
| C | 74.0 | 4.9 | 19.6 | 38.7 | 40.1 | 1.6 | 19.6 | 30.0 |

TABLE 2

| Reference Example | Material coal | Treating temp. (K.) | Treating time (hr) | CO pressure (MPa) | Properties, etc. of upgraded coal: Equilibrium moisture (%) 75% R.H. | 100% R.H. | Elemental analysis (%) Carbon | Hydrogen | Yield (%) | COD of liquid phase (ppm) |
|---|---|---|---|---|---|---|---|---|---|---|
| 1 | A | 593 | 6 | 5 | 7.0 | 10.0 | — | — | 80 | — |
| 2 | B | 553 | 6 | 5 | 6.5 | — | — | — | 91 | 4790 |
| 3 | B | 573 | 6 | 5 | 5.0 | 8.0 | 76.5 | 5.4 | 86 | 6310 |
| 4 | B | 593 | 6 | 5 | 4.2 | 6.7 | — | — | 80 | 7670 |
| 5 | B | 593 | 0.5 | 5 | 5.3 | 8.5 | — | — | 85 | — |
| 6 | C | 573 | 6 | 5 | 4.9 | 6.7 | 75.4 | 5.1 | 86 | 4540 |
| 7 | C | 573 | 6 | 0.5 | 5.5 | 7.5 | — | — | 86 | — |
| 8 | C | 593 | 6 | 5 | 4.1 | 6.0 | — | — | 84 | 6240 |
| 9 | A | 573 | 6 | 0 | 10.0 | 20.0 | 69.5 | 5.9 | 85 | 1910 |
| 10 | A | 593 | 6 | 0 | 8.5 | 16.8 | — | — | 80 | — |
| 11 | B | 553 | 6 | 0 | 8.5 | — | — | — | 89 | 2390 |
| 12 | B | 573 | 6 | 0 | 8.6 | 12.3 | 73.5 | 4.6 | 87 | 3620 |
| 13 | B | 593 | 6 | 0 | 8.0 | — | — | — | 83 | — |
| 14 | C | 573 | 6 | 0 | 6.9 | 10.6 | 74.2 | 4.8 | 90 | 2850 |
| 15 | C | 593 | 6 | 0 | 7.0 | 9.0 | — | — | 85 | — |

REFERENCE EXAMPLES 16–18

The coal C was subjected to three kinds of heat treatments, i.e., (1) the heat treatment of the present invention using carbon monoxide, (2) a heat treatment wherein hydrogen ($H_2$) was used in place of carbon monoxide and (3) a heat treatment wherein neither carbon monoxide nor hydrogen ($H_2$) was used.

The treating conditions were 553° K. (treating temperature), 6 hours (treating time) and 5 MPa (gauge) (addition amount of carbon monoxide or hydrogen). The equilibrium moisture content of the upgraded coal obtained and the gas composition after treatment, in each treatment are shown in Table 3.

TABLE 3

| Reference Example | Gas used (MPa) CO | $H_2$ | Equilibrium moisture (%) 75% R.H. | 100% R.H. | Composition of gas after reaction (%) $H_2$ | CO | $CH_4$ | $CO_2$ |
|---|---|---|---|---|---|---|---|---|
| 16 | 5 | 0 | 6.3 | 8.5 | 4.1 | 81.8 | 0.2 | 13.9 |
| 17 | 0 | 5 | 7.1 | 11.5 | 99.2 | 0.0 | 0.1 | 0.7 |
| 18 | 0 | 0 | 7.5 | 12.3 | — | — | — | — |

Next, there are shown Examples for producing a CWM using a reaction mixture obtained by the heat treatment of a low-rank coal.

EXAMPLE 1

A low-rank coal having the following properties:
elemental analysis on dry ash-free basis
carbon: 74.0%
hydrogen: 4.9% technical analysis for content humidity sample
water: 19.6%
fixed carbon: 38.7%
volatile matter: 40.1%
ash: 1.6%
equilibrium water content
at 75% R.H.: 19.6%
at 100% R.H.: 30.0% was subjected to particle size adjustment so as to have particle sizes of 32–60 mesh. This coal after particle size adjustment was used as the starting material coal.

10 g (on dry ash-free basis) of the above starting material coal and 20 g of pure water were fed into an autoclave having an internal volume of 50 $cm^3$. Carbon monoxide of 5 MPa at room temperature was introduced thereinto. The autoclave contents were kept at a treating temperature of 593° K., for 6 hours with stirring, to conduct heat treatment. In order to measure the degree of coal upgrading and the COD of the liquid phase, the reaction mixture was recovered from the autoclave and immediately filtered to separate the upgraded low-rank coal (upgraded coal) from the liquid phase component. Immediately, the liquid phase was measured for COD.

The yield of the upgraded coal was 84% on dry basis in terms of the ratio of weight of recovered upgraded coal to weight of starting material coal. The equilibrium moisture content of the upgraded coal was 4.1% and 6.0% at 75% R.H. and 100% R.H., respectively. Thus, the coal after the heat treatment was sufficiently upgraded.

The COD value of the liquid phase was as high as 6.240 ppm, indicating that the liquid phase contained a large amount of a component capable of acting as a surfactant.

Using the above-obtained upgraded coal and liquid phase component, a CWM was produced.

The upgraded coal was subjected to particle size adjustment so that the proportion of the coal portion passing through a 200-mesh filter became 80% by weight. The resulting coal was mixed with all the liquid phase component. Thereto was added a surfactant composed mainly of a sodium naphthalenesulfonate-formalin condensate, followed by stirring. In order to allow the surfactant to exhibit its maximum effect, a pH-adjusting agent (3N NaOH solution) was added so that the pH of the liquid component of CWM became about 12. Then, an appropriate amount of water was added to obtain a CWM.

In order to obtain a CWM having a high coal content, good stability and good fluidity, water and the surfactant were added in various amounts. As a result, with the addition of 0.5% by weight, based on the upgraded coal (dry basis), of the surfactant, there could be obtained a CWM of a maximum coal concentration of 65% having good stability and fluidizing.

EXAMPLE 2

A heat treatment was conducted under the same conditions as in Example 1 except that the treating temperature was changed to 573 K. The equilibrium moisture content of the recovered upgraded coal was 4.9% and 6.7% at 75% R.H. and 100% R.H., respectively. The COD value of the liquid phase was 4,540 ppm. The yield of the upgraded coal was 86% on dry basis in terms of the ratio of the weight of recovered upgraded coal to the weight of starting material coal.

Using the above-obtained upgraded coal and liquid phase, a CWM was produced in the same procedure as in Example 1. With the addition of 1% of the surfactant, there could be obtained a CWM of a maximum coal concentration of 60% having good stability and fluidity.

EXAMPLE 3

A heat treatment was conducted under the same conditions as in Example 1 except that the treating temperature was changed to 613° K. The equilibrium moisture content of the recovered upgraded coal was 4.0% and 5.9% at 75% R.H. and 100% R.H., respectively. The COD value of the liquid phase was 7,500 ppm.

Using the above-obtained upgraded coal and liquid phase, a CWM was produced in the same procedure as in Example 1. The liquid phase contained a large amount of components having surface activity; therefore, there could be obtained a CWM of a maximum coal concentration of 67% having good stability and fluidity, without adding any surfactant.

EXAMPLE 4

A heat treatment was conducted under the same conditions as in Example 1 except that the treating temperature was changed to 553° K. and 1 g of $K_2CO_3$ was added. The equilibrium moisture content of the recovered upgraded coal was 6.8% and 10.1% at 75% R.H. and 100% R.H., respectively. The COD value of the liquid phase was 7,070 ppm.

Using the above-described upgraded coal and liquid phase, a CWM was produced in the same procedure as in Example 1. Similarly to Example 3, the liquid phase contained large amount of components having surface activity; therefore, there could be obtained a CWM of a maximum coal concentration of 62% having good stability and fluidity, without adding any surfactant.

COMPARATIVE EXAMPLE 1

The same low-rank coal as used in Example 1 was subjected to particle size adjustment so that the proportion of the coal portion passing through a 200-mesh filter became 80%. Using this low-rank coal (which is upgraded) as a coal for CWM production, a CWM was produced in the same procedure as in Example 1. The addition of 1% of the surfactant was necessary to obtain a CWM of a maximum coal concentration of 42%.

The use of a higher proportion of the surfactant was unable to provide a CWM of coal concentration higher than the above.

As is clear from Example 1 and Comparative Example 1, the process of the present invention enabled the production of a CWM of a high coal concentration which the addition of a low or zero amount of a surfactant.

Although the invention has been described with preferred embodiments, it is to be understood that variations and modifications may be resorted to as will be apparent to those skilled in the art. Such variations and modifications are to be considered within the purview and the scope of the claims appended hereto.

What is claimed is:

1. A process for producing a coal-water mixture usable as a fuel as is, using upgraded low-rank coal having an equilibrium moisture content of less than 11 percent of less at 100 percent relative humidity, said coal-water mixture having a particle size of the coal such that the proportion of the coal portion passing through a 200-mesh filter is 80 percent by weight or more, which process comprises:

heat-treating a low-rank coal having a carbon content of 75 percent or less on dry ash-free basis and an inherent moisture content of 10 percent or more, or an equilibrium moisture water content of 15 percent or more at room temperature and 98 percent relative humidity, in the presence of water and carbon monoxide at the critical temperature of water, 647.3° K., below in a pressure vessel, wherein the weight ratio of the water and low-rank coal used in the heat treatment of low-rank coal is 0.3 to 3.0 and the amount of carbon monoxide present in the reaction system is 1 to 5 MPa in terms of the partial pressure of carbon monoxide during the reaction, said heat treatment being conducted until the coal, after heat treatment, has an equilibrium moisture content of less than 11 percent at 100 percent relative humidity, and recovering the reaction mixture comprising coal and water, from the pressure container, using humic acid as a surfactant as is in the water which has been produced by the heat treatment whereby addition of another surfactant added thereto is eliminated or minimized, and adding the required amount of water to obtain a slurry.

2. The process for producing a coal-water mixture according to claim 1, wherein $K_2CO_3$ is added to the system in the heat treatment.

3. The process for producing a coal-water mixture according to claim 1, wherein the surfactant is composed mainly of a sodium naphthalenesulfonate-formalin condensate.

4. A coal-water mixture usable as a fuel as it is, which is obtained by the process of claim 1 and which comprises 30 to 35 percent of water, 65 to 70 percent of a coal, 0 to 0.7 percent of a surfactant and a small amount of zero amount of a filler, the particle size of the coal being such that the proportion of the coal portion passing through a 200-mesh filter is 80 percent by weight or more.

* * * * *